US005820018A

United States Patent [19]

Stacy

[11] Patent Number: 5,820,018

[45] Date of Patent: Oct. 13, 1998

[54] MAILBOX SYSTEM WITH LOCKABLE BACK DOORS

[75] Inventor: George F. Stacy, Traverse City, Mich.

[73] Assignee: HSS Industries, Inc., Traverse City, Mich.

[21] Appl. No.: 942,829

[22] Filed: Oct. 2, 1997

[51] Int. Cl.[6] ..... B65D 91/00

[52] U.S. Cl. ..... 232/24; 232/25; 232/43.4; 312/265.4; 211/10

[58] Field of Search ..... 232/24, 25, 43.4, 232/17, 45, 43.1; 312/265.1, 265.4, 324, 218, 217; 211/10

[56] References Cited

U.S. PATENT DOCUMENTS

| | | | |
|---|---|---|---|
| 93,006 | 7/1869 | Roberts . | |
| 124,422 | 3/1872 | Conklin . | |
| 652,279 | 6/1900 | Lauer . | |
| 1,027,035 | 5/1912 | Davidson et al. . | |
| 1,142,463 | 6/1915 | Shepherd . | |
| 1,397,438 | 11/1921 | Martin . | |
| 1,629,620 | 5/1927 | Harmony | 232/24 |
| 1,817,191 | 8/1931 | Harmony . | |
| 1,908,173 | 5/1933 | Oestman et al. . | |
| 1,970,267 | 8/1934 | Bales . | |
| 2,912,271 | 11/1959 | Schaefer . | |
| 3,300,016 | 1/1967 | Simijian . | |
| 3,834,612 | 9/1974 | Bixby . | |
| 3,891,288 | 6/1975 | Marquette | 211/206 X |
| 4,135,375 | 1/1979 | Voegeli . | |
| 4,161,274 | 7/1979 | Bishop et al. . | |
| 4,466,676 | 8/1984 | Nilsson . | |
| 4,557,416 | 12/1985 | Stahl et al. | 232/24 |
| 4,813,251 | 3/1989 | Fowler et al. . | |
| 4,836,626 | 6/1989 | Taylor et al. | 312/324 X |
| 4,953,327 | 9/1990 | Cohodar . | |
| 5,061,022 | 10/1991 | Meriwether | 312/324 |
| 5,388,435 | 2/1995 | Bailey . | |
| 5,562,332 | 10/1996 | Stacy . | |
| 5,564,624 | 10/1996 | Davis, Jr. | 232/24 |

FOREIGN PATENT DOCUMENTS

| | | | |
|---|---|---|---|
| 564163 | 9/1958 | Canada | 232/24 |

*Primary Examiner*—Kenneth J. Dorner
*Assistant Examiner*—William L. Miller
*Attorney, Agent, or Firm*—Ian C. McLeod; Mary M. Moyne

[57] ABSTRACT

A mailbox system (10) for the delivery and retrieval of mail, is described. The mailbox system has a rack ladder system (12) within which is mounted mailboxes and parcel lockers (30). The back of the mailbox system is closed by back doors (46 and 48). The doors are mounted by hinges (50) to the rear face plates (42) of the rack ladder system. The doors have a locking system (52) which prevents the doors from being opened from the inside of the boxes or lockers and allows quick and easy access to all the boxes or lockers at the same time. The locking system has a top and bottom lock rod (54 and 56) and a handle assembly (60). When the handle (66) of the handle assembly is rotated, the rods move into and out of top and bottom lock brackets (78 and 80) to allow for locking and unlocking the doors.

21 Claims, 5 Drawing Sheets

MAILBOX SYSTEM WITH LOCKABLE BACK DOORS

BACKGROUND OF THE INVENTION (1) Field of the Invention

The present invention relates to a mailbox system which allows mail to be delivered into one side of the boxes and allows postal customers to retrieve mail from the other side of the boxes. The boxes have individual lockable front doors which allow patrons to retrieve mail from their specific box. The boxes have open backs which are closed by a set of lockable doors to allow easy delivery of the mail into the multiple boxes. The lockable doors have a locking system mounted on the exterior of one of the doors which prevents opening the doors from the inside.

(2) Description of the Related Art

The related art has shown various types of mailbox systems with different methods of delivering mail to the boxes. Illustrative are U.S. Pat. Nos. 1,397,438 to Martin; 1,817,191 to Harmony; 1,908,173 to Oestman et al; 3,834,612 to Bixby; 4,161,274 to Bishop et al and 4,953,327 to Cohodar.

In particular, U.S. Pat. No. 1,817,191 to Harmony shows a mailbox station having multiple doors on the front and a pair of doors on the back. The doors are mounted horizontal such that one door opens upward and the other door opens downward. The doors are linked together to open and close together. The upper door has a flange which overlaps the edge of the bottom door when the doors are in the closed position. The flange can also be provided with a lock.

Also, of interest are U.S. Pat. Nos. 93,006 to Roberts; 124,422 to Conklin; 652,279 to Lauer; 1,027,035 to Davidson et al; 1,142,463 to Shepherd; 1,970,267 to Bales; 2,912,271 to Schaefer; 4,135,375 to Voegeli; 4,466,676 to Nilsson; 4,813,251 to Fowler et al; and 5,388,435 to Bailey which show different types of lockable doors.

In particular, U.S. Pat. No. 1,027,035 to Davidson et al describes a three point locking system for double doors. The locking system includes two vertical bolts and a horizontal latch. The rotation of the latch into and out of locking position simultaneously moves the bolts into and out of the locked position. The doors are preferably similar to those used in buildings to close off rooms from the outside.

Only of minimal interest is U.S. Pat. No. 3,300,016 to Simjian which shows a method of delivering food to a customer using a series of lockable compartments.

There remains the need for a mailbox system which has a plurality of boxes with different sized front doors and a set of back doors which lock from the outside to prevent opening of the back doors from inside the boxes.

OBJECTS

It is therefore an object of the present invention to provide a mailbox system which allows for delivery of the mail into the boxes through lockable back doors. Further, it is an object of the present invention to provide a mailbox system which has a plurality of different sized boxes to allow different sizes and amounts of mail to be delivered. Still further, it is an object of the present invention to provide a mailbox system which is mounted in the wall of a post office to allow easy access to the boxes for delivery of mail but which has lockable back doors to prevent access to the back room of the post office through the larger parcel lockers or mailboxes. Further still, it is an object of the present invention to provide a mailbox system in which the different sizes of mailboxes and parcel lockers are easily interchangeable without having to change the lockable back doors. Further, it is an object of the present invention to provide a mailbox system having back doors which are easily removed to allow for modification and rearrangement of the mailboxes and/or parcel lockers of the system.

These and other objects will become increasingly apparent by reference to the following drawings and the description.

DETAILED DESCRIPTION OF THE PREFERRED EMBODIMENTS

Figure 1:
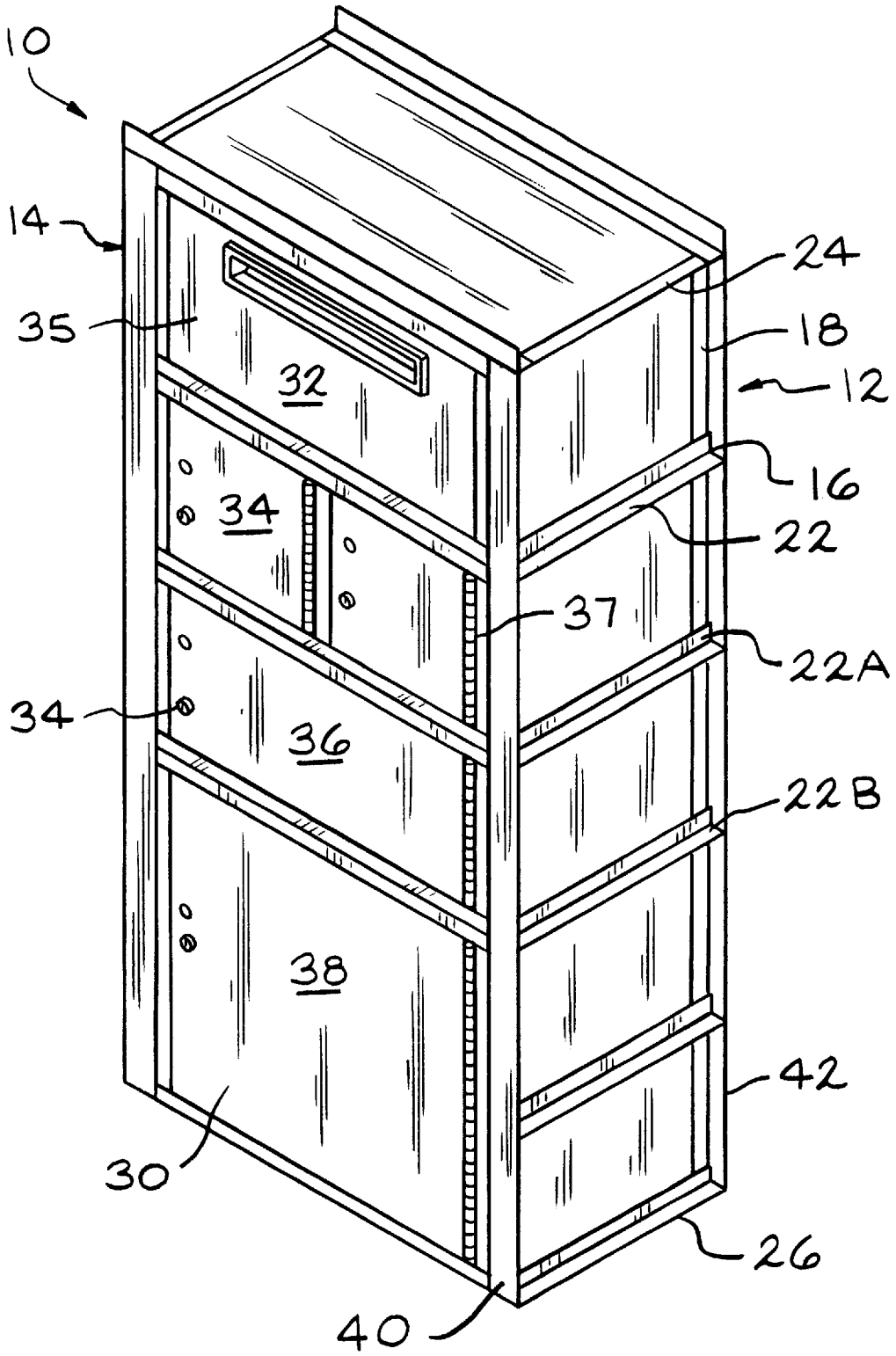
FIG. 1 is a front perspective view of the mailbox system 10 showing the small parcel lockers 34, the medium parcel lockers 36, the large parcel lockers 38 and the mail drop box 32.

The present invention relates to a mailbox system for receiving and removing letters and parcels, which comprises: a rack having opposed, spaced apart sides, a top and a bottom, each side comprising a front vertical rail and a back vertical rail with horizontal rails between the front vertical rails and also between the back vertical rails forming a plurality of openings between the sides; a plurality of lockable boxes having a top wall and a bottom wall with opposed sidewalls extending therebetween so as to form a front opening and a back opening, the lockable boxes mounted in the openings of the rack such that the sidewalls of the lockable boxes are adjacent the front and back vertical rails of the rack with the back opening of the lockable boxes adjacent the back vertical rails and the front opening adjacent the front vertical rails and having a lockable front door for receiving or removing the letters and parcels which is mounted on one of the front rails adjacent the front opening to allow the front opening to be opened and also closed and locked; a pair of back doors mounted on the back vertical rails of the rack, wherein the back doors are of a size such that when the doors are in a closed position, the doors completely close the back openings of the lockable boxes in the rack; and a locking system mounted on an outside of one of the back doors to lock the back doors in the closed position, wherein the locking system comprises a pair of rods each having opposed ends and connected together at one end to a rotatable handle which rotates to insert the other end of each of the rods into brackets mounted on the rack and secures the doors together for securing the doors in the locked position.

Further, the present invention relates to a method of delivering and receiving parcels and letters in a post office, which comprises: providing a mailbox having a rack having opposed, spaced apart sides, a top and a bottom, each side comprising a front vertical rail and a back vertical rail with horizontal rails between the front vertical rails and also between the back vertical rails forming a plurality of openings between the sides; a plurality of lockable boxes having a top wall and a bottom wall with opposed sidewalls extending therebetween so as to form a front opening and a back opening, the lockable boxes mounted in the openings of the rack such that the sidewalls of the lockable boxes are adjacent the front and back vertical rails of the rack with the back opening of the lockable boxes adjacent the back vertical rails and the front opening adjacent the front vertical rails and having a lockable front door for receiving or removing the letters and parcels which is mounted on one of the front rails adjacent the front opening to allow the front opening to be opened and also closed and locked; a pair of back doors mounted on the back vertical rails of the rack, wherein the back doors are of a size such that when the doors are in a closed position, the doors completely close the back openings of the lockable boxes in the rack; and a locking system mounted on an outside of one of the back doors to lock the back doors in the closed position, wherein the locking system comprises a pair of rods each having opposed ends and connected together at one end to a rotatable handle which rotates to insert the other end of each of the rods into brackets mounted on the rack and secures the doors together for securing the doors in the locked position; rotating the handle of the locking system and opening the back doors such that the back openings of the lockable boxes are accessible so that letters and parcels can be inserted into the boxes; closing the back door and rotating the handle of the locking system such that the doors are locked in the closed position; and unlocking and opening the front doors of the lockable boxes for removing the letters and parcels from the lockable boxes through the front opening.

Figures 2, 3:
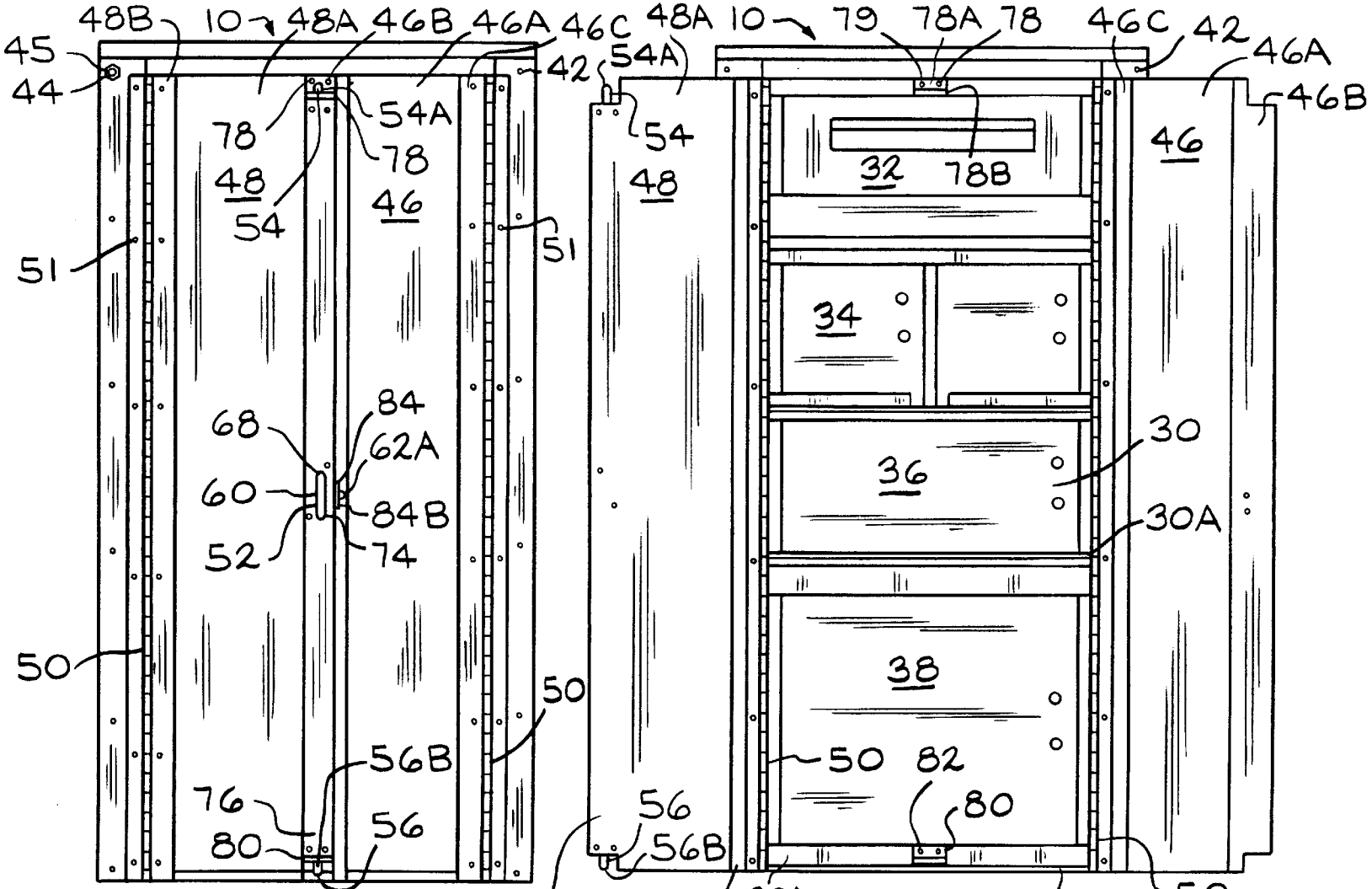
FIG. 2 is a back view of the mailbox system 10 showing the back doors 46 and 48 with the lock system 52 in the closed position.
FIG. 3 is a back view of the mailbox system 10 showing the back doors 46 and 48 in the open position.

FIGS. 1 to 3 show the mailbox system 10 of the present invention. The mailbox system 10 includes a rack ladder system 12 which allows for mounting a plurality of different sized boxes 30. The rack ladder system 12 is preferably similar to those standardly used in U.S. post offices to hold mailboxes and parcel lockers.

The rack ladder system 12 has a left and right side 14 and 16. The left and right sides 14 and 16 are preferably identical and therefore, only the right side 16 will be described in detail (FIG. 1). The right side 16 includes a front vertical rail 18 and a back vertical rail (not shown) which are held in a parallel, spaced apart relationship by a series of horizontal rails 22. The front and back vertical rails 18 are spaced apart a distance slightly greater than the depth of the boxes 30. The vertical rails 18 preferably have a flat rectangular shape and are preferably the same size. The height of the rails 18 will vary depending on the size of the mailbox system 10. The horizontal rails 22 preferably have an angular shape with a first and second leg 22A and 22B. The horizontal rails 22 are preferably mounted on the inner side of the vertical rails 18 adjacent the other pair of vertical rails (not shown) on the opposite side of the rack ladder system 12. Each pair of vertical rails 18 can be provided with one set of horizontal rails 22 on each side which allows each set of vertical rails 18 to be used in two adjacent rack ladder systems 12. The horizontal rails 22 are mounted such that the first leg 22A extends upward toward the top of the mailbox system 10 and the second leg 22B extends inward toward the other side of the rack ladder system 12. The horizontal rails 22 are mounted on the vertical rails 18 such that the first leg 22A of the horizontal rails 22 are fastened to the vertical rails 18. Preferably, the horizontal rails 22 are secured or fastened to the vertical rails 18 by welding. However, any well known means may be used. The horizontal rails 22 of the rack ladder system 12 provide a series of openings or positions within which the boxes 30 are mounted. The boxes 30 preferably include mailboxes (not shown), parcel lockers 34, 36 and 38 and mail drop boxes 32. The boxes 30 preferably all have the same depth. However, the width and height of the boxes 30 varies depending on the use for the boxes 30. Preferably, the width of the boxes 30 is a multiple of the distance between the sides 14 and 16 of the rack ladder system 12. The height of the boxes 30 is preferably a multiple of the distance between the horizontal rails 22 of the rack ladder system 12. FIG. 1 shows a mailbox system 10 with a mail drop box 32 at the top of the system 10 with a small parcel locker 34 just below the drop box 32. A medium parcel locker 36 is positioned below the small parcel lockers 34 and a large parcel locker 38 is located at the bottom of the system 10. The mailboxes 31, mail drop box 32, small and medium parcel lockers 34 and 36 preferably only occupy one position. The large parcel lockers 38 preferably occupy two positions. However, the number of positions occupied by a box 30 is dependent upon the size of the lockers or boxes needed. In the preferred embodiment, the rack ladder system 12 has six (6) horizontal rails 22 spaced approximately about 12.0 inches (30.5 cm) apart including a top rail 24 at the top of the vertical rails 18 and 20 and a bottom rail 26 at the bottom of the vertical rails 18 and 20 (FIG. 1). The rack ladder system 12 preferably has a height of 60.0 inches (152.4 cm). The sides 14 and 16 of the system 12 are preferably spaced 24.0 inches (61.0 cm) apart. In the preferred embodiment, the vertical rails 18 are all constructed of 0.13 inch (0.32 cm) steel and the horizontal rails 20 and 22 are all constructed of 16 gauge steel.

The boxes 30 are preferably mounted in the rack ladder system 12 such that the bottom of the box 30 rests on one set of opposed horizontal rails 22 (one shown). The boxes 30 are preferably provided with a bottom plate 30A which has a width slightly greater than the width of the box 30. The box 30 preferably has a width slightly less than the distance between the horizontal rails 22 such that the boxes 30 can be inserted between the vertical rails 18 and 20 with only the bottom plate 30A making contact with the horizontal rails 22. The bottom plate 30A acts to hold the boxes 30 in position in the rack ladder system 12. The mailboxes and small and medium parcel lockers 34 and 36 are preferably constructed of sheet metal as a single piece. The larger parcel lockers 38 are preferably constructed of several pieces. The lockable front doors 35 of the boxes 30 are mounted by hinges 37 on the framework of the boxes 30. The front doors 35 are preferably mounted on the framework of the boxes 30. The parcel lockers 34, 36 and 38 are preferably similar in construction to the lockable boxes described in Applicant's U.S. Pat. No. 5,562,332 to Stacy. The mailboxes 31 are preferably similar to the 2901, 2902, 2903, 2904 and 2905 models which are used by all post offices. Depending on the use of the boxes 30, the front doors 35 of the boxes 30 can be provided with a standard lock (not shown) or a key return lock system 39. When the boxes 30 are used as mailboxes 31 or post office boxes, the front doors 35 are provided with a standard lock. The postal customer that owns the mailbox 31 has the key to the box 31. When the boxes 30 are used as parcel lockers 34, 36 and 38, the front doors 35 are provided with a key return lock system 39. The box key (not shown) is placed into a postal customer's mailbox 31 to indicate that the customer has a parcel in the other parcel locker. The customer uses the key to open the parcel locker to retrieve the parcel. However, the key is retained in the lock to allow the parcel locker to be used for another postal customer. The parcel lockers 34, 36 and 38 allow customers to easily receive and retrieve larger parcels that will not fit in a standard size mailbox. The postal lockers 34, 36 and 38 are preferably of similar size and can be easily interchanged with the mailboxes 31 which are commonly used by all U.S. Post Offices. The back of the mailbox system 10 is provided with lockable back doors 46 and 48 which close off and secure the back of the parcel lockers 34, 36 and 38 and mail drop box 32 (FIGS. 2 and 3).

A pair of face plates 40 and 42 are mounted on the front and back vertical rails 18 and 20, perpendicular to the rails 18 and 20. The face plates 40 and 42 preferably have a width such as to extend beyond the rails 18 and 20 on either side. The face plates 40 and 42 prevent removal of the boxes 30 from the rack ladder system 12. The rear face plate 42 also provides a mounting surface for hinges 50 for the back doors 46 and 48. The back vertical rails 18 and 20 are provided with threaded studs 44 which allow for mounting the rear face plates 42. The threaded studs 44 extend through holes (not shown) in the rear face plates 42. Nuts 45 are mounted on the threaded studs 44 to secure the rear face plate 42 in position.

The back doors 46 and 48 of the mailbox system 10 include a left and right door 46 and 48 (FIGS. 2 and 3). The doors 46 and 48 are preferably pivotably mounted by piano hinges 50 on the rear face plates 42 on the back vertical rails 20 of the rack ladder system 12. The left door 46 is mounted adjacent the right side 16 of the rack ladder system 12 and has a raised center portion 46A with flanges 46B and 46C on each of the sides of the door 46. The flanges 46B and 46C extend backwards and then outward away from the raised center portion 46A of the door 46. The left side flange 46B is connected by the piano hinge 50 to the rear face plate 42 of the rack ladder system 12. The right side flange 46B extends outward from the raised center portion 46A such that when the left door 46 is in the fully closed position, the right side flange 46B extends beyond the center point of the rack ladder system 12 in the back of the mailbox system 10. The outermost portion of the right side flange 46B is slightly shorter in length than the remainder of the door 46 such that the bottom of the flange 46C is spaced above the bottom of the door 46 and the top of the flange 46B is spaced below the top of the door 46.

The right door 48 is preferably mounted by the piano hinge 50 on the rear face plate 42 adjacent the left side 14 of the rack ladder system 12 and also has a raised center portion 48A with a right side flange 48B and a left side flange 48C. The right side flange 48B is similar to the left side flange 46C of the left side door 46. The right side flange 48B of the right door 48 extends backward and outward away from the raised center portion 48A. The right side flange 48B is connected by the piano hinge 50 to the rear face plate 42 of the rack ladder system 12. The left side flange 48C of the right door 48 is not back set. The left side flange 48C of the right door 48 extends outward at the same raised position as the center portion 48A of the door 48. The left side flange 48B of the right door 48 is also slightly shorter in length than the remainder of the door 48. The left side flange 48C of the right door 48 has such a width that when the doors 46 and 48 are in the completely closed position, the left side flange 48C of the right door 48 completely overlaps the right side flange 46B of the left door 46. The doors 46 and 48 are preferably constructed of 16 gauge vinyl coated galvanized steel. In the preferred embodiment, the doors 46 and 48 have a height of 60.0 inches (152.4 cm). The left door 46 has a width of 11.0 inches (27.9 cm) and the right door 48 has a width of 14.0 inches (35.6 cm).

The locking system 52 preferably includes a top lock rod 54, a bottom lock rod 56, a rotatable handle assembly 60 and a top and bottom lock bracket 78 and 80 and a handle lock bracket 84. In the preferred embodiment, the rods 54 and 56 have a cylindrical shape with an upper and lower end 54A, 56A, 54B and 54C and are approximately the same length. The top lock rod 54 is mounted such that the lower end 54A of the rod 54 is connected to the handle assembly 60 and the upper end 54A of the rod 54 extends upward beyond the flanges 46B, and 48C of the doors 46 and 48. The bottom lock rod 56 is mounted similarly but in the opposite direction such that the upper end 56A of the rod 56 is mounted on the handle assembly 60 and the lower end 56B of the rod 56 extends downward beyond the bottom of the flanges 46B and 48C of the doors 46 and 48. A holding bracket 58 is provided adjacent the top and bottom of the flanges 46B and 48C on the left side flange 48C of the right door 48. The brackets 58 act to hold the top and bottom lock rods 54 and 56 in alignment during vertical movement.

The handle assembly 60 includes a disc 62 and a handle 68. The disc 62 is rotatably mounted by a mounting bracket 66 on the left side flange 48C of the right door 48. The top portion of the disc 62 is pivotably connected to the lower end 54B of the top lock rod 54. Similarly, the bottom portion of the disc 62 is pivotably connected to the upper end 56A of the bottom lock rod 56. The disc 62 has a latch extension 62A between the top and bottom portions which extends outward beyond the left side flange 48C of the right door 48 when the locking system 52 is in the closed position. The disc 62 also has an aperture 62B in the center for connecting the handle 68 for rotating the disc 62. The handle 68 includes a shaft 70, a brace 72 and a knob 74.

Figure 4:
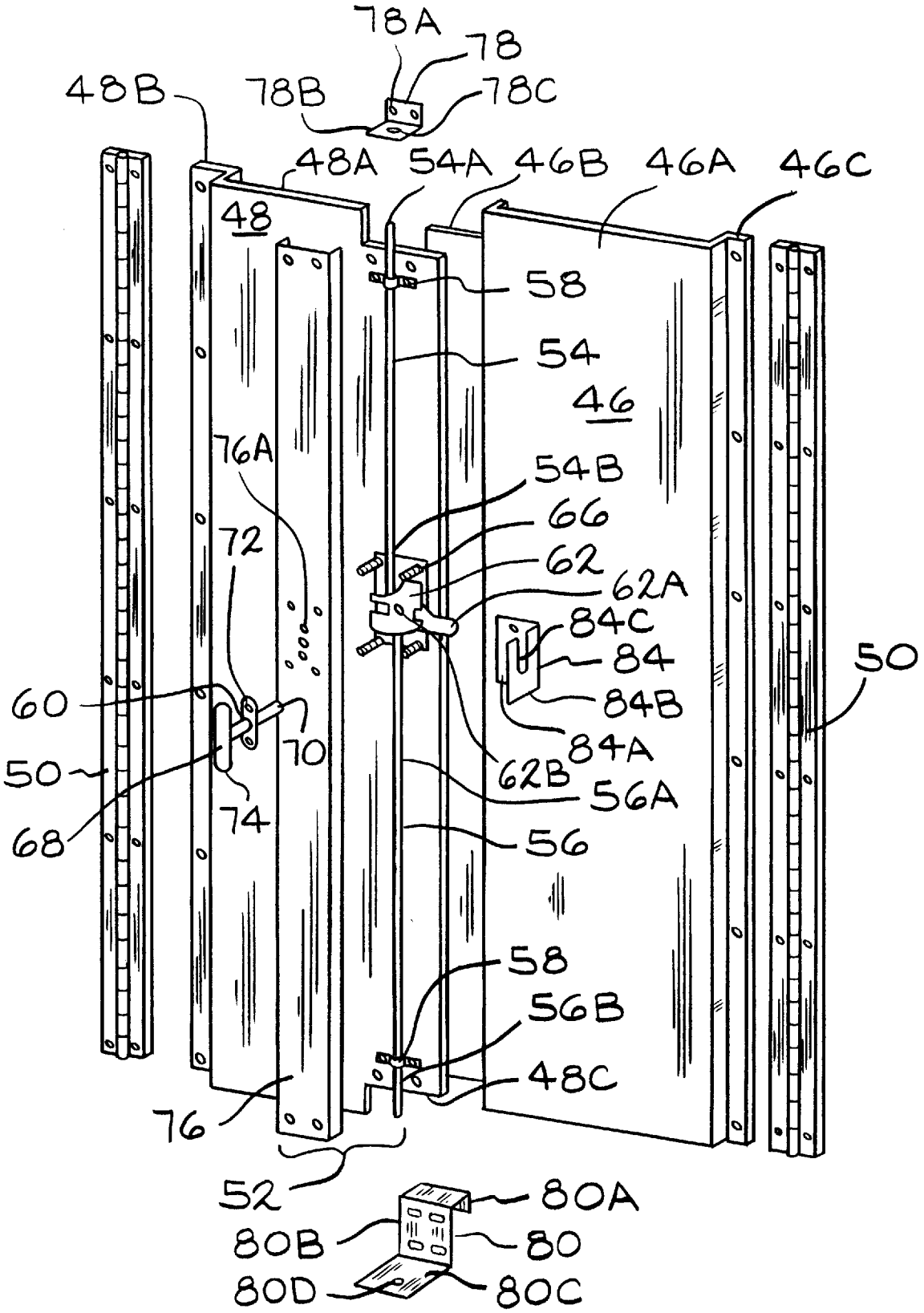
FIG. 4 is an exploded view of the back doors 46 and 48 showing the rods 54 and 56 and handle 68 of the locking system 52.

A cover 76 is provided over the rods 54 and 56 and the disc 62 and is mounted on the left side flange 48C of the right door 48 (FIG. 4). The cover 76 is U-shaped such as to completely cover the rods 54 and 56 and disc 62 and prevent access to the rods 54 and 56 and disc 62 and to prevent contact with the rods 54 and 56 or disc 62 which could unlock the door or prevent the doors 46 and 48 from locking. The cover 76 has an aperture 76A adjacent the disc 62. The aperture 76A allows for mounting the handle 68 to the disc 62. The shaft 70 extends through the aperture 76A in the cover 76 and is securely connected at one end to the aperture 62B in the disc 62. The brace 72 is mounted on the outside of the cover 76 and holds the shaft 70 horizontal in the aperture 62B in the disc 62. The knob 74 is mounted on the opposite end of the shaft 70 and is preferably perpendicular to the shaft 70 such as to form a T-shape with the shaft 70. The cover 76 is bolted onto the flange 48C of the right door 48 at the top and bottom and also in the center adjacent the handle assembly 60.

The top lock bracket 78 is preferably in the form of a 90° angle with a first and second leg 78A and 78B. In the preferred embodiment, the second leg 78B is longer than the first leg 78A and has a hole 78C for allowing the upper end 54A of the top lock rod 54 to extend through the bracket 66. The top lock bracket 78 is preferably mounted such that the first leg 78A is secured to the upper frame of the top box 30 of the mailbox system 10 and the second leg 78B extends outward away from the doors 46 and 48 perpendicular to the doors 46 and 48. The top lock bracket 78 is mounted such that the first leg 78A extends above the second leg 78B.

However, the top lock bracket 78 could also be mounted in the other direction with the second leg 78B above the first leg 78A.

In the preferred mailbox system 10 with the large parcel locker 38 in the lowermost position, the bottom lock bracket 80 is a single, unitary piece (FIG. 4). The lock bracket 80 preferably has a combination U and L shape. The lock bracket 80 has a first U-shaped portion with a short leg 80A and a long leg 80B. The long leg 80B of the first U-shaped portion forms the long leg 80B of the L-shaped portion. The short leg 80C of the L-shaped portion extends outward away from the U-shaped portion perpendicular to the long leg 80B. The short leg 80C of the L-shaped portion has the hole 80D for holding the lower end 56B of the bottom lock rod 56. The lock bracket 80 is mounted over the lower, back framework 38A of the large parcel locker 38 such that the short leg 80C of the L-shaped portion extends outward level with the floor of the large parcel locker 38. The U-shaped portion is hooked over the bottom framework 38A of the large parcel locker 38. The long leg 80B common to both portions is preferably fastened by rivets 82 to the bottom framework 38A of the locker 38.

Figure 5:
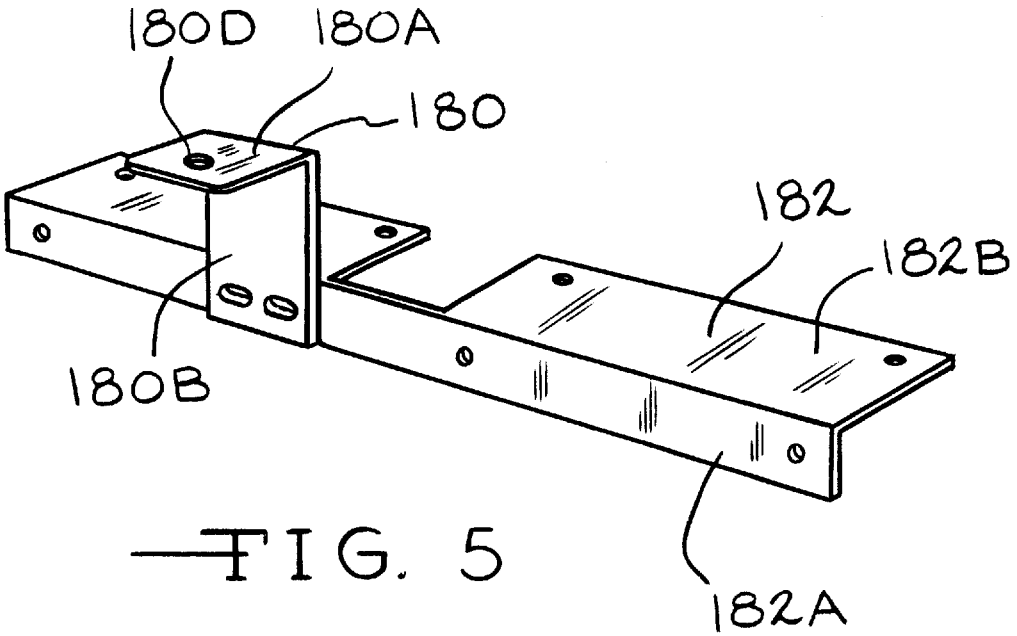
FIG. 5 is a perspective view of the bottom lock bracket 180 of one alternate embodiment.
Figure 7:
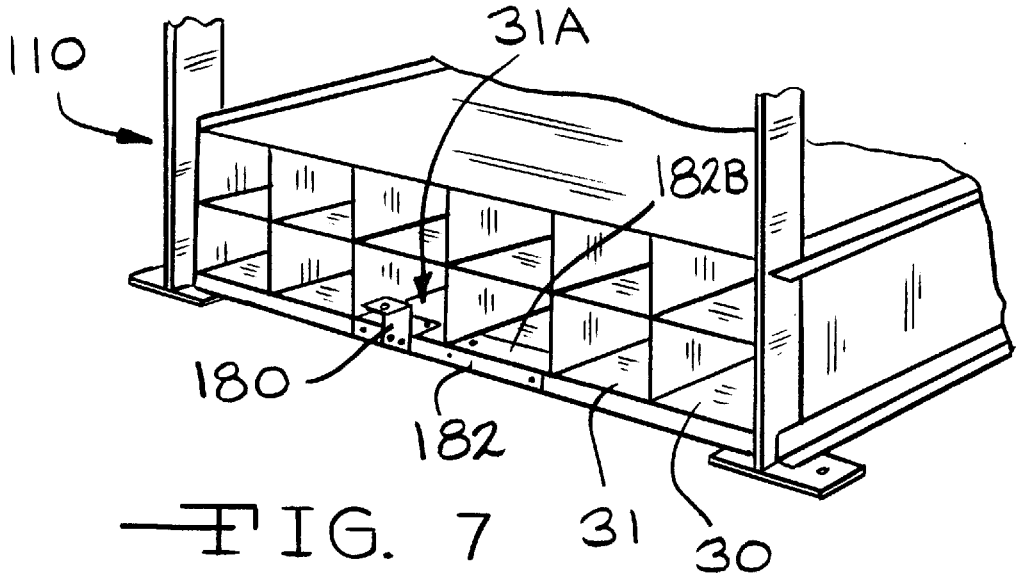
FIG. 7 is a perspective partial view of the mailbox system 110 of an alternate embodiment showing the bottom lock bracket 180 mounted on the mailboxes 31.

In an alternate embodiment, the bottom lock bracket 180 has an L-shape with a short leg 180A and a long leg 180B. The bracket 180 is mounted to an L-shaped bracket 182 (FIG. 5). The long leg 180B of the lock bracket 180 is mounted on the short leg 182A of the L-shaped bracket 182 such that the long leg 182B of the bracket 182 extends outward perpendicular to the long leg 180B of the lock bracket 180 and such that the short leg 182A of the bracket 182 extends downward. The short leg 180A of the bottom lock bracket 180 extends outward perpendicular and above the long leg 180B. The short leg 180A has a hole 180D for holding the lower end 56B of the bottom lock rod 56. The long leg 182B of the L-shaped bracket 182 is preferably parallel to and mounted to the floor 31A of the mailbox 31 (FIG. 7). The L-shaped bracket 182 with the lock bracket 180 is preferably used for mailbox systems 110 which use the 2901, 2902, 2903 or 2904 on the bottom portion.

Figure 6:
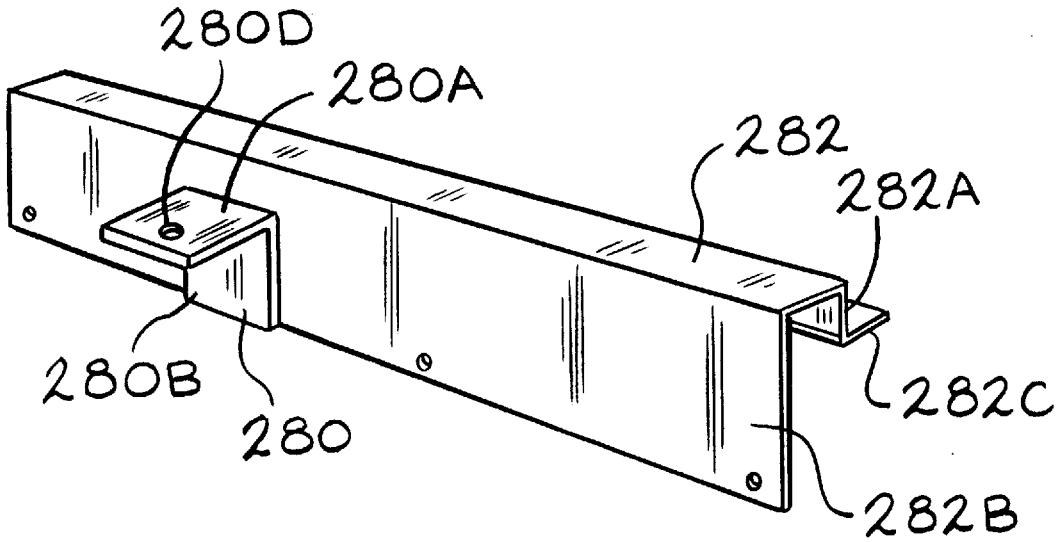
FIG. 6 is a perspective view of the bottom lock bracket 280 of another alternate embodiment.
Figure 8:
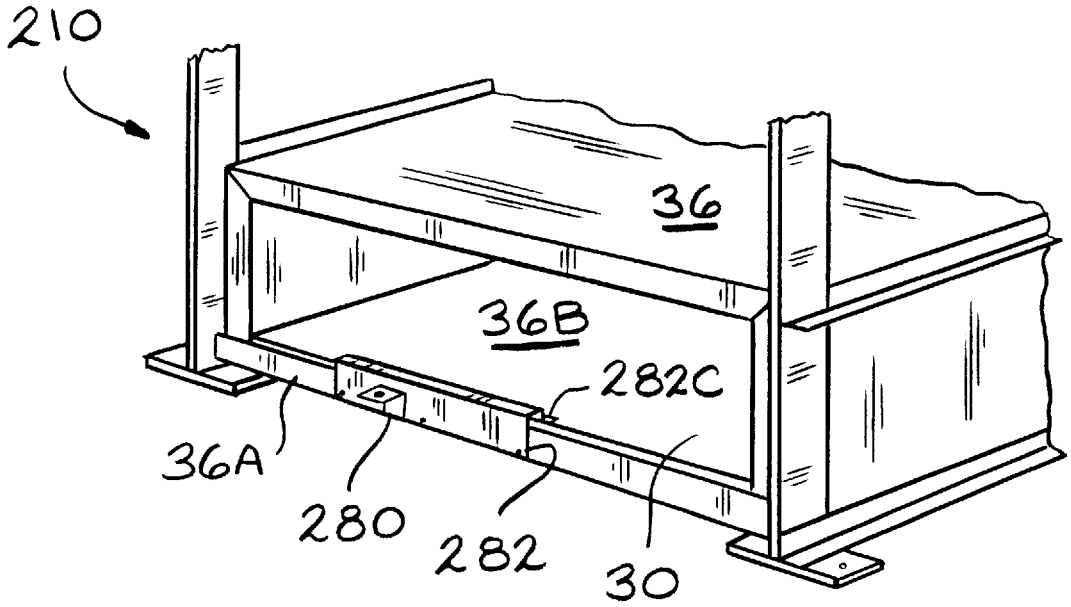
FIG. 8 is a perspective partial view of the mailbox system 10 of another alternate embodiment showing the bottom lock bracket 280 mounted on the medium parcel locker 36.

In another alternative embodiment, the lowermost portion of the mailbox system 210 has medium parcel lockers 36 similar to the PL-1 or PL-2 sold by HSS Industries located in Traverse City, Mich. (FIG. 8). The bottom lock bracket 280 has an L-shape with a short leg 280A and a long leg 280B. The short leg 280A of the bottom lock bracket 280 extends outward perpendicular and above the long leg 280B. The short leg 280A has a hole 280D for holding the lower end 56B of the bottom lock rod 56. The bracket 280 is mounted to a mounting bracket 282 which preferably has an essentially U-shape with a long leg 282B and a short leg 282A (FIG. 6). The short leg 282A also has a flange 282C which extends outward from the short leg 280A perpendicular to the legs 282A and 282B and in a direction away from the long leg 282B. The bracket 282 is mounted over the lower back framework 36A of the locker 36 such that the flange 282C is parallel to and in contact with the floor 36B of the locker 36. The flange 282C is preferably mounted to the floor 36B of the locker 36. The long leg 282B is preferably fastened to the back, lower framework 36A of the locker 36. The first leg 280A of the lock bracket 280 is mounted on the long leg 282B of the mounting bracket 282 such that the short leg 280A is above the long leg 280B and extends outward perpendicular to the long legs 280B and 282B of the brackets 280 and 282.

In all three embodiments, the holes 78C, 80D, 180D and 280D in the legs 78B, 80C of the top and bottom lock brackets 78, 80, 180 and 280 are larger in diameter than the diameter of the rods 54 and 56 such that the rods 54 and 56 can easily extend through the holes 78C, 80D, 180D and 280D in the lock brackets 78, 80, 180 and 280. The configuration of the lower lock bracket is preferably varied depending on the configuration of the lowest box of the mailbox system 10.

The handle lock bracket 84 is preferably mounted on the right side flange 46B of the left door 46. In the preferred embodiment, the handle lock bracket 84 has a 90° L-shape with a first and second leg 84A and 84B. The second leg 84B is provided with a U-shaped notch 84C. The bracket 84 is mounted such that the first leg 84A is secured on the flange of the left door 46 and the second leg 84B extends outward perpendicular to the door 46 with the opening of the notch 84C extending upward. The bracket 84 is mounted such that the first leg 84A extends inward toward the left door 46.

In the preferred embodiment, the rods 54 and 56 have a length of 29.0 inches (73.7 cm) with a diameter of 0.313 inches (794 cm) and are constructed of zinc plated cold roll. In the locked position, the rods 54 and 56 extend upward and downward through the top and bottom lock brackets 78 and 80 a distance of 0.63 inches (1.59 cm). The rods 54 and 56 extend above and below the flanges 46B, 46C and 48B, 46C of the doors 46 and 48 and prevent the doors 46 and 48 from being opened. The handle lock bracket 84 helps to secure the doors 46 and 48 and also prevents the handle assembly 60 from being rotated too far and possibly allowing the rods 54 and 56 to be moved into the open position.

The mounting of the back doors 46 and 48 on the rack ladder system 12 preferably allows for easy mounting of the doors 46 and 48 as well as easy removal of the doors 46 and 48 to allow the boxes 30 in the rack ladder system 12 to be rearranged. In the preferred embodiment, the piano hinges 50 are mounted on the face plates 42 by drill screws 51. The use of drill screws 51 removes the necessity of predrilling holes (not shown) in the face plates 42. In the preferred embodiment, the right door 48 is mounted first. Next, the right door 48 is held in the closed position with the handle assembly 60 in the locked position. The top and bottom lock brackets 78 and 80 (to be described in detail hereinafter) are slid over the upper end 54A of the top lock rod 54 and the lower end 56B of the bottom lock rod 56 and the positions for the mounting screws or rivets 79 for the brackets 78 and 86 are marked. The positions are then drilled and the brackets 78 and 86 are mounted on the uppermost and lowermost boxes by carriage bolts, self tapping bolts or rivets 79 or 82. The left door 46 is then mounted similar to the right door 48. Next, the handle lock bracket 84 is fastened onto the right door 48 to allow rearrangement of the boxes 30 in the rack ladder system 12, the back doors 46 and 48 and the rear face plates 42 are removed. The back doors 46 and 48 and rear face plates are removed together. First, the doors 46 and 48 are unlocked and moved apart. Next, the nuts 45 mounted on the threaded studs 44, which secure the rear face plates 42, are removed. Once the rear face plates 42 are removed, the doors 46 and 48 are also removed since the doors 46 and 48 are connected to the face plates. The boxes 30 can then be moved out of the rack ladder system 12 and new boxes 30 can be replaced into the system 12. Thus, removal of the doors 46 and 48 for rearrangement of the boxes 30 is very simple. The rear face plates 42 must be removed from the rack ladder system 12 to rearrange the boxes 30 regardless of whether the mailbox system 10 has back doors 46 and 48.

IN USE

The mailbox system 10 is preferably installed in the walls of post offices (not shown) such that the front doors 35 of the boxes 30 are accessible to the public while the back doors 46 and 48 of the system 10 are accessible only from the back area mail room. The mailbox system 10 can have a variety of different mailbox 31 and parcel locker 34, 36 and 38 configurations depending upon the needs of the post office. To use the system 10, the postal worker first opens the back doors 46 and 48 of the system 10. The worker opens the doors 46 and 48 by rotating the knob 74 of the handle assembly 60 in a counterclockwise direction. As the handle assembly 60 is rotated, the latch extension 62A of the locking system 52 is rotated upward out of the U-shaped notch 84C of the handle lock bracket 84. At the same time, the lower end 54B of the top lock rod 54 is moved downward by the disc 62 and the upper end 56A of the bottom rod 56 is moved upward by the rotation of the disc 62. The pivotable connections of the ends 54B and 56A of the rods 54 and 56 on the disc 62 allows the rotation of the knob 74 and disc 62 to vertically move the rods 54 and 56. As the handle assembly 60 is rotated, the upper and lower ends 54A and 56B of the top and bottom rods 54 and 56, respectively are moved out of the lock brackets 78 and 80. Once the rods 54 and 56 are completely free of the top and bottom lock brackets 78 and 80 and the latch extension 62A is free of the handle lock bracket 84, the right door 48 can be opened which then allows the left door 46 to be opened. The overlapping of the doors 46 and 48 and the exterior mounting of the locking system 52 prevents the doors 46 and 48 from being unlocked or broken through from the inside of the boxes 30. Thus, even if the front doors 35 of the mailboxes 31 or parcel lockers 34, 36 and 38 are broken into, the back doors 46 and 48 can not be opened. In addition, the back doors 46 and 48 are constructed of 16 gauge vinyl coated galvanized steel to provide strength to prevent forcing the doors 46 and 48 or busting the doors 46 and 48 from the inside.

Once the rear doors 46 and 48 are fully open, the postal worker can deposit the letters and parcels (not shown) in the appropriate boxes 30 or lockers 34, 36 and 38. In addition, the postal worker can remove the mail (letters) deposited into the mail drop box 32. The single set of double doors 46 and 48 allows quick and easy access to all the boxes 30 of a rack ladder system 12 at the same time which makes delivery of the mail more efficient. Once all the mail has been delivered, the postal worker closes the left door 46 and then the right door 48 and then rotates the handle assembly 60 of the locking system 52 into the locked position. If necessary, the locking system 52 can be provided with a lock (not shown) which would prevent rotation of the handle assembly 60 unless a key was used. However, since the doors 46 and 48 are located in the back mail room, in the preferred embodiment, a lock is not necessary. To retrieve mail from the mailbox system 10, a postal customer obtains the key to one of the mailboxes 31 or postal lockers 34, 36 and 38. In the preferred embodiment, all front doors 35 of the boxes 30 and lockers 34, 36 and 38 have different locks. The postal customer then can access the interior of the box 30 by opening the doors 46 and 48. If the postal customer wishes to place something in the mail, the postal customer would place the letter or small parcel in the slot of the mail drop box 32.

It is intended that the foregoing description be only illustrative of the present invention and that the present invention be limited only by the hereinafter appended claims.

I claim:

1. A mailbox system for receiving and removing letters and parcels, which comprises:

(a) a rack having opposed, spaced apart sides, a top and a bottom, each of the sides comprising a front vertical rail and a back vertical rail with horizontal rails between the front vertical rails and also between the back vertical rails forming a plurality of openings between the sides;

(b) a plurality of lockable boxes having a top wall and a bottom wall with opposed sidewalls extending therebetween so as to form a front opening and a back opening, the lockable boxes mounted in the openings of the rack such that the sidewalls of the lockable boxes are adjacent the front and back vertical rails of the rack with the back opening of the lockable boxes adjacent the back vertical rails and the front opening adjacent the front vertical rails and having a lockable front door for receiving or removing the letters and parcels which is mounted on one of the front rails adjacent the front opening to allow the front opening to be opened and also closed and locked;

(c) a pair of back doors mounted on the back vertical rails of the rack, wherein the back doors are of a size such that when the doors are in a closed position, the doors completely close the back openings of the lockable boxes in the rack; and (d) a locking system mounted on an outside of one of the back doors to lock the back doors in the closed position, wherein the locking system comprises a pair of rods each having opposed ends and connected together at one end to a rotatable handle which rotates to insert the other end of each of the rods into brackets mounted on the rack and secures the doors together for securing the doors in the locked position.

2. The mailbox system of claim 1 wherein each of the back doors are mounted on the back vertical rails by a piano hinge.

3. The mailbox system of claim 1 wherein the back doors are mounted on the back vertical rails on each of the sides of the rack such that the doors open in a vertical direction and wherein the doors are easily removed to allow for removal of the lockable boxes from the rack.

4. The mailbox system of claim 1 wherein one of the back doors has a width between the sides of the rack equal to one half of a width between the sides and wherein the other one of the back doors has a width greater than half the width between the sides such that when the back doors are in the closed position, one of the back doors overlaps the other of the back doors.

5. The mailbox system of claim 4 wherein the locking system is mounted on the one of the back doors.

6. The mailbox system of claim 1 wherein the back doors have opposed edges and wherein one of the edges of the back doors is mounted on the vertical rails.

7. The mailbox system of claim 6 wherein the back doors comprising a first door and a second door and wherein the first door has a width between the edges slightly greater than one half of a width between the sides of the rack system such that in the closed position, a side of the first door overlaps a side of the second door.

8. The mailbox system of claim 7 wherein the rods and handle are mounted adjacent to the edge of the first door which overlaps the second door.

9. The mailbox system of claim 7 wherein the rods and handle are mounted on the outside of the first door adjacent to the second door.

10. The mailbox system of claim 1 wherein the rods are covered by a cover and wherein the handle extends through the cover to allow the locking system to be operated.

11. The mailbox system of claim 1 wherein the brackets are mounted on an uppermost and a lowermost of the horizontal rails adjacent the top and bottom respectively of the rack system.

12. The mailbox system of claim 11 wherein the brackets each comprise a plate with a hole through which the end of the rod is extended.

13. The mailbox system of claim 7 wherein a latch is provided on a plate pivotably securing the ends of the rods adjacent the handle and wherein the handle acts to move the plate with the latch into and out of locking position in a bracket mounted on the second door.

14. The mailbox system of claim 13 wherein to disengage the locking system, the handle is rotated in the counterclockwise direction which retracts the rods out of the brackets and which lifts the latch out of the bracket.

15. The mailbox system of claim 1 wherein the back doors are constructed of 16 gauge vinyl coated galvanized steel.

16. The mailbox system of claim 1 wherein some of the lockable boxes are parcel lockers and wherein there are at least two of the parcel lockers mounted in the rack system.

17. The mailbox system of claim 1 wherein the lockable boxes are two parcel lockers of a size so that the parcel lockers fill one of the openings in the rack system.

18. The mailbox system of claim 1 wherein at least one of the lockable boxes is a mailbox having a slot to allow delivery of mail into the mailbox.

19. A method of delivering and receiving parcels and letters in a post office, which comprises:

(a) providing a mailbox having a rack having opposed, spaced apart sides, a top and a bottom, each of the sides comprising a front vertical rail and a back vertical rail with horizontal rails between the front vertical rails and also between the back vertical rails forming a plurality of openings between the sides; a plurality of lockable boxes having a top wall and a bottom wall with opposed sidewalls extending therebetween so as to form a front opening and a back opening, the lockable boxes mounted in the openings of the rack such that the sidewalls of the lockable boxes are adjacent the front and back vertical rails of the rack with the back opening of the lockable boxes adjacent the back vertical rails and the front opening adjacent the front vertical rails and having a lockable front door for receiving or removing the letters and parcels which is mounted on one of the front rails adjacent the front opening to allow the front opening to be opened and also closed and locked; a pair of back doors mounted on the back vertical rails of the rack, wherein the back doors are of a size such that when the doors are in a closed position, the doors completely close the back openings of the lockable boxes in the rack; and a locking system mounted on an outside of one of the back doors to lock the back doors in the closed position, wherein the locking system comprises a pair of rods each having opposed ends and connected together at one end to a rotatable handle which rotates to insert the other end of each of the rods into brackets mounted on the rack and secures the doors together for securing the doors in the locked position;

(b) rotating the handle of the locking system and opening the back doors such that the back openings of the lockable boxes are accessible so that the letters and parcels can be inserted into the boxes;

(c) closing the back door and rotating the handle of the locking system such that the doors are locked in the closed position; and (d) unlocking and opening the front doors of the lockable boxes for removing the letters and parcels from the lockable boxes through the front opening.

20. The method of claim 19 wherein at least one of the lockable boxes is a mailbox having a slot in the front door and wherein the letters are deposited through the slot into the box and the letters are removed from the box through the back opening when the back doors are open.

21. The method of claim 19 wherein at least one of the lockable boxes is a the parcel locker which is mounted in one of the openings and wherein parcels are received and removed from the parcel locker.

* * * * *

UNITED STATES PATENT AND TRADEMARK OFFICE

CERTIFICATE OF CORRECTION

PATENT NO. : 5,820,018

DATED : October 13, 1998

INVENTOR(S) : George F. Stacy

It is certified that error appears in the above-identified patent and that said Letters Patent is hereby corrected as shown below:

Title page under "U.S. Patent Documents", "Simijian" should be --Simjian--.

Column 2, line 33, "10 of another" should be --210 of another--.

Column 8, line 18 "(0.313 inches (794 cm)" should be --0.313 inches (.794 cm)--.

Column 8, line 22, "46B, 46C and 48B, 46C" should be --46B, 46C and 48B, 48C--.

Column 12, line 37 (Claim 21), "the" after "boxes is a" should be deleted.

Column 12, line 38 (Claim 21), --the-- should be inserted after "wherein" and before "parcels--.

Signed and Sealed this

Eleventh Day of May, 1999

*Attest:*

Q. TODD DICKINSON

*Attesting Officer*

*Acting Commissioner of Patents and Trademarks*